United States Patent [19]

Mori et al.

[11] Patent Number: 4,621,499

[45] Date of Patent: Nov. 11, 1986

[54] GAS TURBINE COMBUSTOR

[75] Inventors: Takanobu Mori; Tetsuo Kashimura; Yutaka Fukui, all of Hitachi; Yoshimi Yanai, Kitaibaraki; Nobuyuki Iizuka, Hitachi, all of Japan

[73] Assignee: Hitachi, Ltd., Tokyo, Japan

[21] Appl. No.: 754,665

[22] Filed: Jul. 11, 1985

Related U.S. Application Data

[63] Continuation of Ser. No. 528,148, Aug. 31, 1983, abandoned.

[30] Foreign Application Priority Data

Sep. 3, 1982 [JP] Japan ..... 57-152603

[51] Int. Cl.[4] ..... F02C 1/00; C22C 19/05

[52] U.S. Cl. ..... 60/752; 148/410

[58] Field of Search ..... 60/752, 755, 756, 757, 60/758, 759, 760; 148/410

[56] References Cited

U.S. PATENT DOCUMENTS

| | | | |
|---|---|---|---|
| 3,099,134 | 7/1963 | Calder et al. | 60/752 |
| 3,937,628 | 2/1976 | Watanabe et al. | 75/134 F |
| 4,283,234 | 8/1981 | Fukui et al. | 148/410 |

*Primary Examiner*—Louis J. Casaregola
*Assistant Examiner*—Timothy S. Thorpe
*Attorney, Agent, or Firm*—Antonelli, Terry & Wands

[57] ABSTRACT

A gas turbine combustor defines a combustion chamber for combustion of injected fuel and for introduction of the resultant hot combustion gas to nozzles of a gas turbine. The combustor has parts subjected to hot combustion gas during operation of the turbine, such as a cap connected to a fuel injection nozzle, a liner connected to the cap, and a transition piece connected to the liner. These parts subjected to the hot combustion gas are made from an alloy having a composition consisting essentially of 0.02 to 0.2 wt % of C, 15 to 30 wt % of Cr and 10 to 25 wt % of W.

5 Claims, 15 Drawing Figures

GAS TURBINE COMBUSTOR

This application is a continuation, of application Ser. No. 528,148, filed Aug. 31, 1983, now abandoned.

BACKGROUND OF THE INVENTION

The present invention relates to a novel combustor of gas turbine and, more particularly, to a gas turbine combustor made of an Ni base alloy having a high resistance to thermal fatigue.

Combustors of gas turbines are usually shaped by cold working from sheet materials which in turn are formed by hot working from ingot of alloy. The alloy used as the material of the gas turbine combustor, therefore, is required to have good hot workability and cold workability. The alloy must have also a high resistance to thermal fatigue because the combustor is subjected to repetitional heat cycles consisting of heating by the hot combustion gas and subsequent cooling.

The present inventors have found that alloys having large tensile reduction of area at room temperature exhibit superior cold workability and also that high resistance to thermal fatigue is exhibited by alloys which have high tensile proof stress, tensile reduction of area, creep rupture strength and creep rupture reduction of area at high temperature.

A heat-resistant Ni base alloy called "hastelloy X", consisting essentially of 0.1 wt % of C, 22 wt % of Cr, 9 wt % of Mo, 0.5 wt % of W, 1 wt % of Co, 19 wt % of Fe and the balance Ni, has been used most popularly as the material of the gas turbine combustors.

On the other hand, there is an increasing demand for higher performance of gas turbines. This in turn requires a rise of the temperature of the working fluid, i.e. the higher temperature of the combustion gas. In consequence, the inner cylinder of the gas turbine combustor, the temperature of which is not raised above 750° C. in the conventional gas turbine, is heated up to a high temperature exceeding 750° C. Unfortunately, however, the above-mentioned common material hastelloy X cannot provide sufficient resistance to thermal fatigue at such a high temperature.

Namely, the hastelloy X, which is an alloy having a superior strength at high temperature owing mainly to solid solution strenghtening by Mo, exhibits only a low tensile proof stress at high temperature region above 750° C., and shows only small creep rupture strength and creep rupture reduction of area. The hastelloy X, therefore, cannot provide sufficient thermal fatigue strength as the material of combustors for modern gas turbines.

Japanese Patent Laid-Open No. 18315/75 discloses an austenitic alloy of solid-solution strengthening type, consisting essentially of not greater than 0.1 wt % of C, not greater than 1.5 wt % of Al, not greater than 1 wt % of Ti and/or Nb, not greater than 75 wt % of Co, not greater than 26 wt % of Cr, 8 to 40 wt % of W, 38 to 46 wt % of [1/5 (wt % Co)+(wt % Cr)+(wt % W)], not greater than 0.1 wt % of Mg, not greater than 0.1 wt % of B, not greater than 0.5 wt % of Zr, not greater than 1 wt % of Hf and the balance substantially Ni. This literature, however, does not disclose nor suggest at all the application of this material to gas turbine combustors, and fails to mention the thermal fatigue resistance which is an essential requisite for the gas turbine combustor materials which have to withstand severe condition of use, i.e. repetitional heat cycles consisting of heating by hot combustion gas and subsequent rapid cooling.

SUMMARY OF THE INVENTION

Accordingly, it is a primary object of the invention to provide a gas turbine combustor made from an alloy which exhibits a higher resistance to thermal fatigue than the conventionally used alloy materials.

More specifically, the invention aims at providing a gas turbine combustor made from an alloy which exhibits a $10^4$-hour creep rupture strength not smaller than 3 $Kg/mm^2$ at 850° C.

To this end, according to the invention, there is provided a gas turbine combustor defining a combustion chamber for combustion of injected fuel and for introduction of the resultant hot combustion gas to nozzles of a gas turbine, wherein the parts of the combustor subjected to the hot combustion gas are made from an alloy having a composition consisting essentially of 0.02 to 0.2 wt % of C, 15 to 30 wt % of Cr, 10 to 25 wt % of W, and the balance not smaller than 20 wt % of Ni.

The above and other objects, features and advantages of the invention will become clear from the following description of the preferred embodiment taken in conjunction with the accompanying drawings.

DESCRIPTION OF THE PREFERRED EMBODIMENTS

Figure 1:
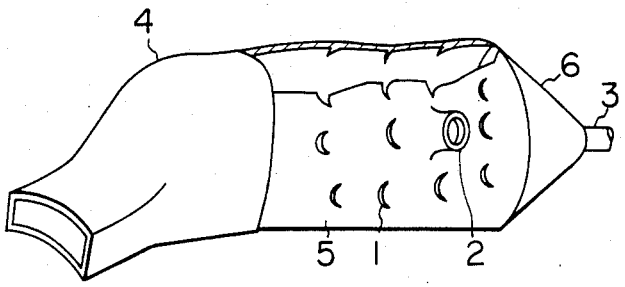
FIG. 1 is a partly cut-away perspective view of a typical conventional gas turbine combustor.

FIG. 1 is a partly cut-away perspective view of a typical conventional gas turbine combustor. The combustor has a fuel nozzle 3 for injecting a fuel which is introduced through a cap 6 into a liner 5 so as to be burnt in the latter. The resultant combustion gas is introduced through a transition piece 4 into a turbine blade section in which annular rows of-stationary vanes and moving vanes are arranged in stages. Air necessary for the combustion is introduced through a multiplicity of crescent-shaped louver ports 1. The combustor is provided also with a cross-fire tube port 2. In the gas turbine combustor of the type described, parts such as the cap 6, liner 5 and the transition piece 4 are subjected to the high temperature of the combustion gas and the heat resistant alloy of the invention is used for these parts. Particularly, as shown in FIG. 1, the louver ports 1 cut and raised from the body of the liner 5 to have sharp notchs are kept under a severe condition partly because they are subjected to the repetitional heat cycles of rapid heating and cooling and partly because stress is concentrated to the sharp notchs. In consequence, the liner 5 is liable to be cracked at the sharp notchs of the louver ports 1 due to thermal fatigue, unless it is made from an alloy which has a high strength at high temperature, as well as high ductility at high temperature.

According to the invention, these parts of the gas turbine combustor subjected to the high temperature are made from a special alloy which is an Ni base alloy having a composition essentially consisting of, as basic constituents, 0.02 to 0.2 wt % of C, 15 to 30 wt % of Cr, 10 to 25 wt % of W and the balance not smaller than 20 wt % of Ni.

According to one aspect of the invention, the alloy used as the material of the gas turbine combustor of the invention is characterized by containing at least one of not greater than 1 wt % of Si and not greater than 1.5 wt % of Mn, in addition to the basic constituents mentioned above.

According to another aspect, the gas turbine combustor is made from an alloy which contains, with or without the addition of above mentioned Si and Mn, at least one of not greater than 40 wt % of Co, not greater than 2 wt % of Al, not greater than 3 wt % of Ti, not greater than 3 wt % of Nb, not greater than 0.1 wt % of Mg, not greater than 0.5 wt % of Zr, not greater than 0.5 wt % of rare earth element and not greater than 0.1 wt % of B, in addition to the basic constitutents as mentioned before.

The material of gas turbine combustor is required to have a high strength at high temperature and a large ductility, as well as little precipitation of sigma phase, for the following reasons.

(a) The tendency of thermal fatigue resembles that of high-temperature fatigue which is the fatigue caused in a material held at a high temperature. In order to withstand thermal fatigue, therefore, it is necessary to increase the resistance to high-temperature fatigue, i.e. to have a high proof stress at high temperature.

(b) The following relationship exists between the plastic strain amplitude $\Delta\epsilon_p$ and the number of repetition of heat cycles in a thermal fatigue test.

$$\sqrt{N} \cdot \epsilon_p \approx \frac{\epsilon_f}{2}$$

where, $\epsilon_f$ represents the ductility as observed in tensile test. From this formula, it will be understood that, in order to withstand the thermal fatigue, it is necessary to have a large reduction of area in the tensile test or a large creep rupture reduction of area.

(c) The thermal fatigue is closely related to the precipitation of sigma phase at high temperature. Namely, the precipitation of sigma phase unfavorable decreases the creep rupture strength and the creep rupture reduction of area. In order to resist to the thermal fatigue, therefore, it is necessary to suppress the precipitation of sigma phase.

According to the invention, the contents of respective constituents of the alloy are determined for the following reasons.

The addition of C, when its content is not smaller than 0.02 wt %, makes a solid solution in the alloy or causes a precipitation of carbides during use at high temperature, to increase the proof stress and creep strength at high temperature advantageously. However, addition of C in excess of 0.2 wt % causes a too heavy carbide precipitation at high temperature to undesirably lower the tensile reduction of area at high temperature. For this reason, the C content should be selected to range between 0.02 and 0.2 wt %, preferably between 0.05 and 0.15 wt %.

Cr is an element which makes a solid solution in the alloy to increase the proof stress and creep strength, as well as resistance to oxidation of alloy at high temperature and resistance to sulfuric corrosion. In order to enjoy these effects, it is necessary that the Cr content is 15 wt % at the smallest. However, Cr content exceeding 30 wt % causes a precipitation of sigma phase to reduce the creep rupture reduction of area. The preferable range in Cr content is 18 to 26 wt %, particularly 20 to 24 wt %.

Not smaller than 10 wt % of W makes a solid solution in the alloy to remarkably increase the proof stress at high temperature, as well as the creep rupture strength. However, W content exceeding 25 wt % undesirably impairs the hot and cold workability and promotes the precipitation of sigma phase to unfavourable decrease the creep rupture reduction of area. The preferable range in W content is 12 to 20 wt %, particularly 14 to 16%.

Co is an element which makes a solid solution in the alloy to remarkably increase the creep rupture strength at both of room temperature and high temperature. Addition of Co in excess of 45 wt %, however, promotes the precipitation of sigma phase to decrease the creep rupture strength. The preferable upper limit in Co content is 40 wt %. The particularly preferable range in Co content is 29 to 31 wt %.

Al content less than 2 wt % makes solid solution in the alloy and promotes the precipitaion of gamma prime phase during long use at high temperature to increase the proof stress under tension at high temperature, as well as the creep rupture strength. The creep rupture reduction of area, however, is decreased undesirably when the Al content exceeds 2 wt %. The preferable range in Al content is 0.1 to 1.2 wt %, particularly 0.6 to 0.9 wt %.

Ti or Nb makes solid solution in the alloy when added by an amount not greater than 3 wt %. The addition of not greater than 3 wt % of Ti or Nb promotes the precipitation of gamma prime phase during long use at high temperature to increase the proof stress and the creep rupture strength at high temperature. If the Ti content or Nb content solely or the sum of Ti and Nb contents exceed 3 wt %, the creep rupture reduction of area is decreased. The preferable range in Ti and/or Nb content is 0.1 to 2.5 wt %, particularly 1 to 2 wt %.

To contain Fe should be avoided as far as possible because the addition of this element decreases the creep rupture strength. In case where Fe is contained as an impurity, the Fe content should be made not greater than 5 wt %, preferably not greater than 2 wt % and more preferably not greater than 0.2 wt %.

Si and Mn are added as deoxidation agents. The addition of Si and Mn is preferred because it improves the hot workability. The creep rupture strength, however, is decreased unfavourably by the addition of more than 1 wt % of Si or more than 1.5 wt % of Mn. Therefore, the Si and Mn contents should be determined so as not to exceed 1 wt % and 1.5 wt %, respectively. Particularly preferable Si and Mn contents are 0.2 to 0.6 wt % and 0.4 to 1.0 wt %, respectively.

Elements such as Mg, B and Zr, as well as rare earth elements, segregates in austenite grain boundary of the alloy to increase the creep rupture strength. Only one, two or more of these elements are added. Excessive addition of these elements, however, decreases the bonding strength of the grain boundary to reduce the creep rupture reduction of area. Therefore, the contents of Mg, B, Zr and the rare earth element should be selected not to exceed 0.1 wt %, 0.1 wt %, 0.5 wt % and 0.5 wt %, respectively. Particularly preferable ranges in contents of Mg, B, Zr and the rare earth element are 0.005 to 0.05 wt %, 0.002 to 0.01 wt %, 0.01 to 0.2 wt % and 0.005 and 0.1 wt %, respectively.

To sum up, the alloy used as the material of gas turbine combustor of the invention preferably has a composition which consists essentially of 0.05 to 0.15 wt % of C, 0.2 to 0.6 wt % of Si, not greater than 1 wt % of Mn, 20 to 24 wt % of Cr, 14 to 16 wt % of W, 29 to 31 wt % of Co, 0.6 to 0.9 wt % of Al, 1.2 to 1.9 wt % of Ti, 0.03 to 0.10 wt % of La, not greater than 2 wt % of Fe, 0.002 to 0.01 wt % of B and the balance substantially Ni. It is preferable that the ratio Ti/Al is 1.5 to 3.0.

Regarding the structure and heat treatment for the alloy material of gas turbine combustor of the invention, the alloy preferably has a structure consisting of fully austenite phase obtained through a solid solution treatment. The solid solution treatment is effected by holding the alloy at a temperature between 1100° and 1200° C. for 15 minutes to 2 hours, followed by a water cooling or air cooling. The water cooling is conducted by cooling the alloy of a predetermined temperature by dipping the same in water. In the case where the alloy has been shaped into a sheet, the water cooling may be made by spraying water onto the alloy sheet surface.

The alloy used as the material of the gas turbine combustor of the invention is preferably prepared by melting constituent elements in a non-oxidizing atmosphere. Since the constituent metals are used in the form of pure metals, it is recommended that these metals are heated under vacuum up to a temperature at which the meltdown is just going to start, and are then molten while filling the vessel with the non-oxidizing gas. Such a way of preparation is preferred because it affords higher yields of the alloy elements and eliminates any fluctuation of the alloy composition.

By effecting a vacuum arc re-melting or electroslag re-melting of the thus prepared alloy, it is possible to obtain a good hot workability and a high creep rupture strength without requiring the addition of Sn and Mn. The Si and Mn contents, when these elements are not added, are 0.01 wt % and 0.02 wt %, respectively.

A description will be made hereinunder as to how the gas turbine combustor of the invention is produced. The combustor is produced into a desired shape by welding of the shaped alloy sheets. After the welding, in order to remove residual strain, it is preferred to effect a solid solution treatment followed by an air cooling and, as required, an aging treatment. Preferably, the alloy in the form of sheet is subjected to a solid solution treatment in advance to the forming into the shape of the combustor. It is also preferred that the welding is made by arc welding employing a filler metal having the same alloy composition as the alloy used in the invention as the combustor material.

Embodiment 1

Table 1 shows chemical compositions of alloy Nos. 1 to 14 usable as the combustor material in accordance with the invention, together with that of conventionally used hastelloy X. These alloys were obtained by heating the raw materials to a temperature at which the meltdown is just going to start under vacuum of $10^{-5}$ Torr., allowing them to melt after filling argon gas to form ingots, forming rods of 15 mm dia. by subjecting the ingots to a hot working, and subjecting the rods to a solid solution treatment which consists in holding the rods at 1150° C. for 30 minutes and a subsequent water cooling.

In the preparation of the alloys, the following materials were used: electrolytic nickel; graphite powder wrapped by Al foil (addition of C); metallic silicon; metallic manganese; electrolytic chromium; compacted and fired W and Mo powder; metallic cobalt; aluminum; sponge titanium; metallic niobium; nickel-magnesium alloy; nickel-boron alloy; sponge zirconium; electrolytic iron; mischmetal; and lanthanum.

The alloys in accordance with the invention contained not greater than 5 wt % of Fe. All of these alloys showed crystal grains consisting of polygonal fully austenite structure, except that the alloy of sample No. 7, having a W content of 23.7 wt %, showed crystal grains consisting of polygonal austentic structure with slight crystallization of W.

TABLE 1

| Sample | | Elements | | | | | | | | | | | | |
|---|---|---|---|---|---|---|---|---|---|---|---|---|---|---|
| | | C | Si | Mn | Cr | W | Co | Al | Ti | Nb | Mg | B | others | Ni |
| hastelloy X | | 0.08 | 0.29 | 0.66 | 21.3 | 0.7 | 1.2 | — | — | — | — | 0.001 | Mo 8.9, Fe 18.5 | 48.4 |
| Alloys of | No. 1 | 0.07 | 0.10 | 0.01 | 21.9 | 15.1 | 0.1 | 0.1 | 1.9 | — | 0.02 | 0.003 | Zr 0.01 | 60.7 |
| invention | No. 2 | 0.07 | 0.24 | 0.21 | 21.9 | 15.1 | 0.1 | 1.0 | 0.9 | — | 0.02 | 0.007 | — | 60.5 |
| | No. 3 | 0.07 | 0.26 | 0.20 | 21.9 | 15.2 | 14.6 | 0.5 | 0.5 | 0.5 | 0.02 | 0.006 | — | 46.3 |
| | No. 4 | 0.07 | 0.25 | 0.22 | 22.1 | 15.0 | 29.6 | 0.5 | 0.5 | 0.5 | 0.02 | 0.004 | — | 31.2 |
| | No. 5 | 0.06 | 0.37 | 0.68 | 21.9 | 15.2 | 39.9 | 0.1 | 0.1 | — | 0.02 | 0.002 | mischmetal (0.25) | 20.9 |
| | No. 6 | 0.06 | 0.25 | 0.72 | 28.3 | 10.8 | 0.1 | 0.4 | 0.9 | — | 0.02 | 0.003 | — | 58.5 |
| | No. 7 | 0.06 | 0.28 | 0.65 | 15.2 | 23.7 | 0.1 | 0.5 | 1.0 | — | 0.02 | 0.004 | — | 58.5 |
| | No. 8 | 0.07 | 0.28 | 0.67 | 22.0 | 15.3 | 29.7 | 0.4 | 1.5 | — | — | 0.006 | La 0.02, Fe 0.2 | 29.7 |
| | No. 9 | 0.07 | 0.32 | 0.68 | 22.0 | 15.5 | 29.8 | 0.8 | 1.5 | — | — | 0.003 | La 0.07 | 29.3 |
| | No. 10 | 0.07 | 0.29 | 0.68 | 21.8 | 15.1 | 29.8 | 1.2 | 1.5 | — | — | 0.004 | La 0.01, Fe 1.9 | 27.6 |
| | No. 11 | 0.07 | 0.30 | 0.68 | 21.9 | 15.3 | 20.5 | 0.8 | 1.5 | — | — | 0.004 | La 0.02 | 38.9 |
| | No. 12 | 0.08 | 0.32 | 0.68 | 22.1 | 14.9 | 30.1 | 0.8 | 0.9 | — | — | 0.003 | La 0.01, Fe 0.1 | 30.0 |
| | No. 13 | 0.08 | 0.31 | 0.68 | 22.0 | 15.0 | 30.1 | 0.8 | 1.9 | — | — | 0.005 | La 0.02, Fe 0.1 | 29.0 |
| | No. 14 | 0.06 | 0.33 | 0.67 | 21.7 | 14.9 | 30.3 | 0.7 | 1.4 | — | — | 0.006 | La 0.03 | 29.8 |

TABLE 2

| sample name | | mechanical properties | | | | | |
|---|---|---|---|---|---|---|---|
| | | room temp. | 850° C. | | | | |
| | | tensile reduction of area (%) | proof stress (kgf/mm$^2$) | tensile reduction of area (%) | $10^4$-hour creep rupture strength (kgf/m$^2$) | $10^3$-hour creep rupture strength (Kgf/m$^2$) | $10^3$-hour creep rupture reduction of area (%) |
| hastelloy X | | 51 | 18 | 59 | 3.0 | 4.8 | 15 |
| Alloys of invention | No. 1 | 63 | 20 | 68 | 4.5 | 6.7 | 40 |
| | No. 2 | 54 | 30 | 53 | 6.0 | 9.7 | 45 |
| | No. 3 | 62 | 23 | 72 | 5.3 | 7.9 | 45 |
| | No. 4 | 66 | 25 | 77 | 5.8 | 8.6 | 60 |
| | No. 5 | 65 | 24 | 44 | 8.0 | 10.8 | 45 |
| | No. 6 | 58 | 25 | 61 | 5.7 | 8.2 | 50 |
| | No. 7 | 60 | 28 | 55 | 6.4 | 9.2 | 50 |
| | No. 8 | 65 | 22 | 81 | 5.2 | 8.5 | 70 |
| | No. 9 | 62 | 39 | 84 | 8.9 | 13.0 | 80 |
| | No. 10 | 63 | 38 | 70 | 6.9 | 11.0 | 60 |
| | No. 11 | 46 | 40 | 55 | 7.2 | 11.3 | 30 |
| | No. 12 | 70 | 25 | 88 | 6.9 | 9.8 | 85 |
| | No. 13 | 61 | 47 | 77 | 9.8 | 14.1 | 75 |

Table 2 shows the values of tensile reduction of area at room temperature, proof stress and reduction of area as obtained with the sample materials through a tensile test conducted at 850° C., as well as values of $10^4$-hour and $10^3$-hour creep rupture strengths and $10^3$-hour creep rupture reduction of area at 850° C.

As will be understood from Table 2, the alloys in accordance with the invention showed values of reduction of area at room temperature of 46% or higher, proof stress at 850° C. of 20 Kg/mm$^2$ or higher, $10^3$-hour and $10^4$-hour creep rupture strengths of not smaller than 6.7 Kg/mm$^2$ and 4.5 Kg/mm$^2$, respectively, and reduction of area after $10^3$-hour creep rupture test of 30% or higher, which are quite superior to those exhibited by the conventional material. From this test result, it is expected that the alloy in accordance with the invention exhibits a high resistance to thermal fatigue.

An explanation will be made hereinunder as to the influence of each element on the alloy used as the combustor material of the invention.

Figure 2:
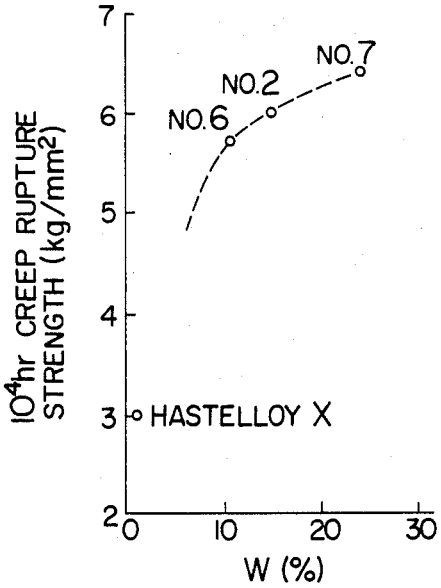
FIGS. 2 to 4 are diagrams showing how $10^4$-hour creep rupture strength, proof stress and $10^3$-hour creep rupture reduction of area are related to W content of the alloy.
Figure 3:
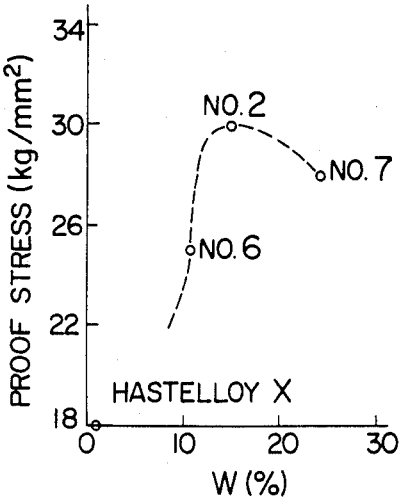
Figure 4:
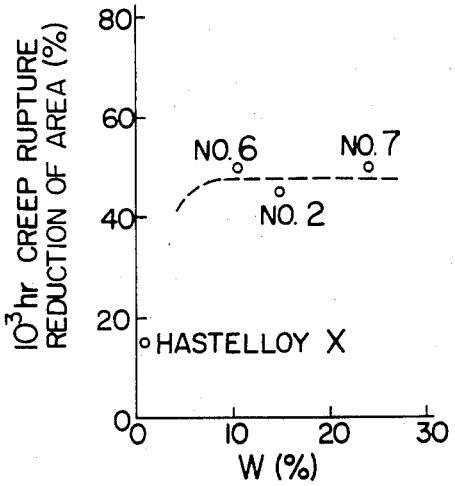
Figure 5:
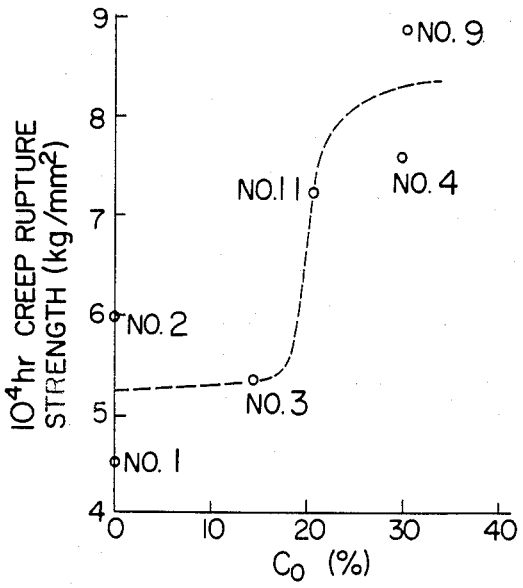
FIGS. 5 to 8 are diagrams showing how $10^4$-hour creep rupture strength, proof stress, tensile reduction of area and $10^3$-hour creep rupture reduction of area are related to Co content of the alloy.
Figure 6:
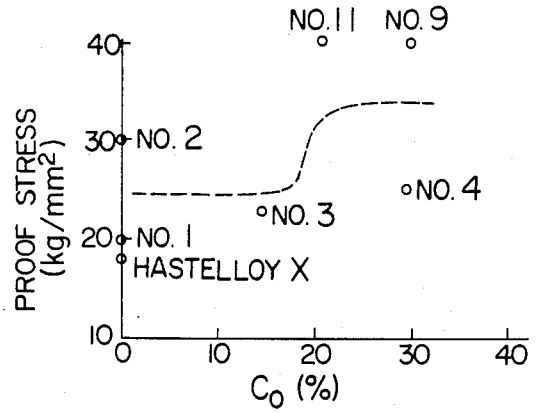
Figure 7:
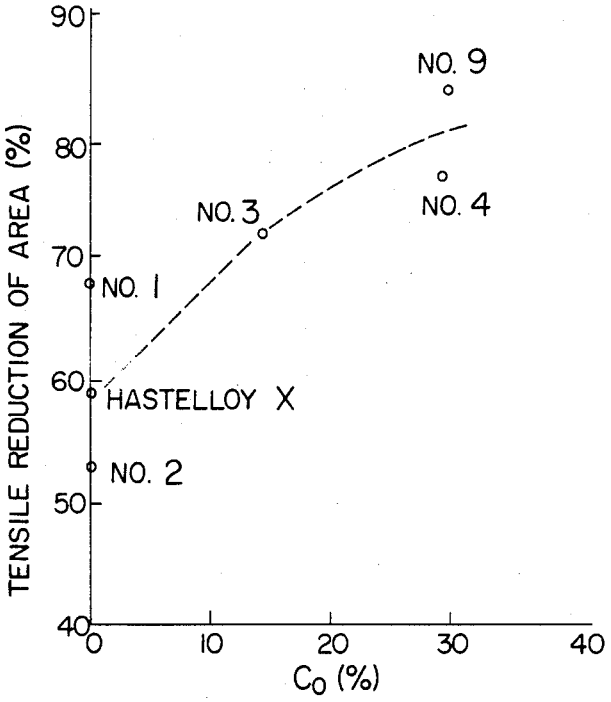
Figure 8:
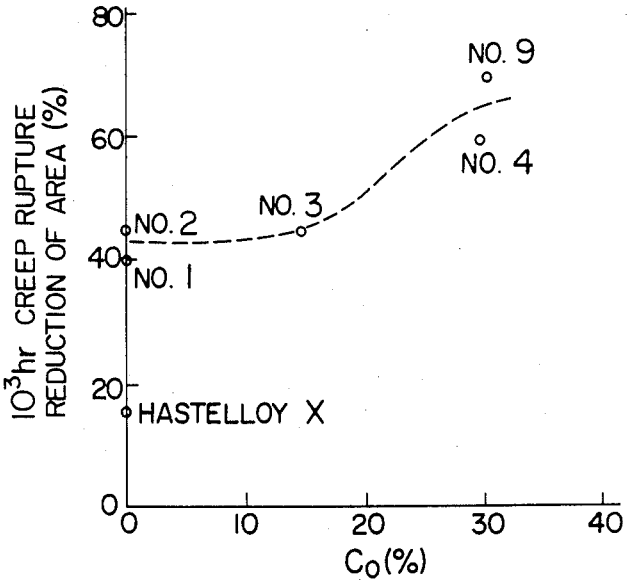

FIGS. 2 to 4 show, respectively, how the $10^4$-hour creep rupture strength, proof stress and $10^3$-hour creep rupture reduction of area, which are shown in Table 2, are influenced by W content. As will be seen from these Figures, addition of not smaller than 10 wt % of W ensures remarkable effects which could never be attained in the conventionally used hastelloy X. The alloys shown in these Figures were obtained by adding various amounts of W to an alloy having a basic chemical composition consisting essentially of 0.06 to 0.07 wt % of C, 0.24 to 0.28 wt % of Si, 0.21 to 0.72 wt % of Mn, 15.2 to 28.3 wt % of Cr, 0.1 wt % of Co, 0.4 to 1.0 wt % of Al, 0.9 to 1.0 wt % of Ti, 0.02 wt % of Mg, 0.003 to 0.007 wt % of B and the balance Ni. As will be seen from these Figures, a $10^4$-hour rupture strength not smaller than 5.5 Kg/mm$^2$ and proof stress not smaller than 24 Kg/mm$^2$ were observed with the W content of 10 to 25 wt %.

FIGS. 5 to 8 are diagrams showing, respectively, the influence of Co content on the $10^4$-hour creep rupture strength, proof stress, tensile reduction of area and $10^3$-hour creep rupture reduction of area. As will be seen from these Figures, the strength and ductility are remarkably improved by the addition of Co. Particularly, addition of Co in excess of 15% brought about a remarkable increase in the $10^4$-hour rupture strength up to 5.2 Kg/mm$^2$ or higher, as well as drastic increase in the proof stress and tensile reduction of area up to 23 Kg/mm$^2$ or higher and up to 72% or higher, respectively.

The alloys employed in the test for obtaining data shown in FIGS. 5 to 8 were prepared by adding various amounts of Co to an Ni base alloy having a composition consisting essentially of 0.07 wt % of C, 0.10 to 0.32 wt % of Si, 0.01 to 0.68 wt % of Mn, 21.9 to 22.0 wt % of Cr, 15.0 to 15.5 wt % of W, 0.1 to 10 wt % of Al, 0.5 to 1.9 wt % of Ti (Al+Ti being 1.0 to 2.3 wt %), and 0.003 to 0.007 wt % of B, with the addition of at least one of 0.5% of Nb, 0.02% of Mg and 0.01 wt % of Zr.

Figure 9:
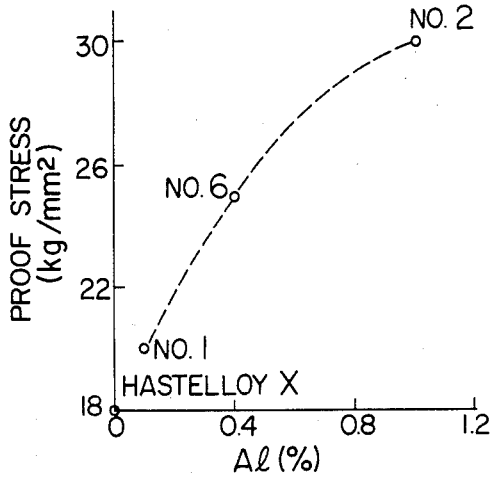
FIGS. 9 to 11 are diagrams showing how proof stress, $10^3$-hour creep rupture reduction of area and $10^4$-hour creep rupture strength are related to the Al content of the alloy.
Figure 10:
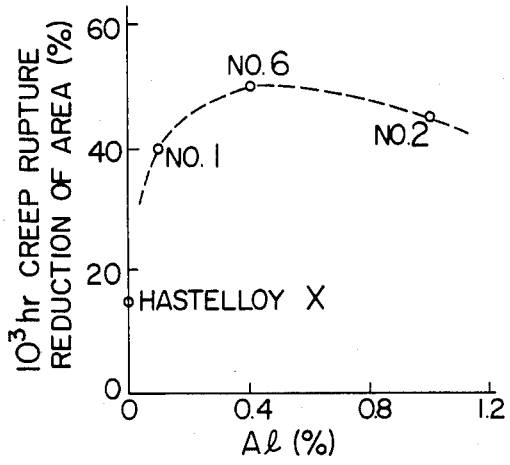
Figure 11:
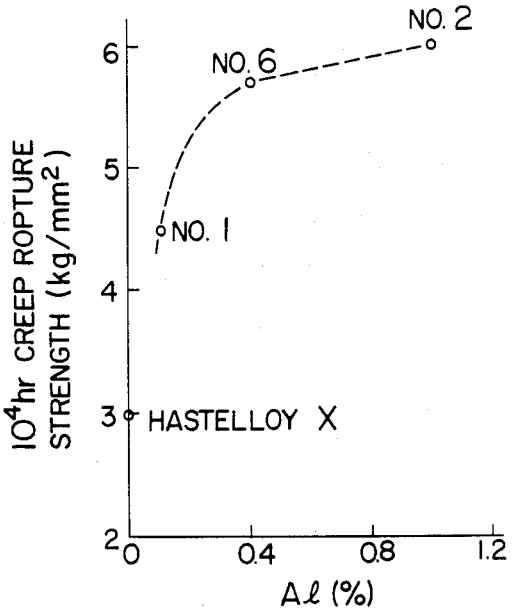

FIGS. 9 to 11 are diagrams showing the influence of Al on the proof stress, $10^3$-hour creep rupture reduction of area and $10^4$-hour creep rupture strength which are shown in Table 2. It will be understood from these Figures that the addition of Al remarkably improves the $10^4$-hour creep rupture strength, $10^3$-hour creep rupture reduction of area and the proof stress, in the alloys having high W contents. Particularly, addition of Al in excess of 0.1 wt % provides drastic increase in the $10^4$-hour creep rupture strength and $10^3$-hour creep rupture reduction of area up to 4.5 Kg/mm$^2$ or higher and up to 40 % or higher, respectively.

The alloys employed in the test for obtaining data shown in these Figures were prepared by adding various amounts of Al to an Ni base alloy having a composition consisting essentially of 0.06 to 0.07 wt % of C, 0.10 to 0.25 wt % of Si, 0.01 to 0.72 wt % of Mn, 21.9 to 28.3 wt % of Cr, 10.8 to 15.1 wt % of W, 0.1 wt % of Co, 0.9 to 1.9 wt % of Ti, 0.02 wt % of Mg, 0.003 to 0.007 wt % of B with an addition of 0.01 wt % of Zr.

Figure 12:
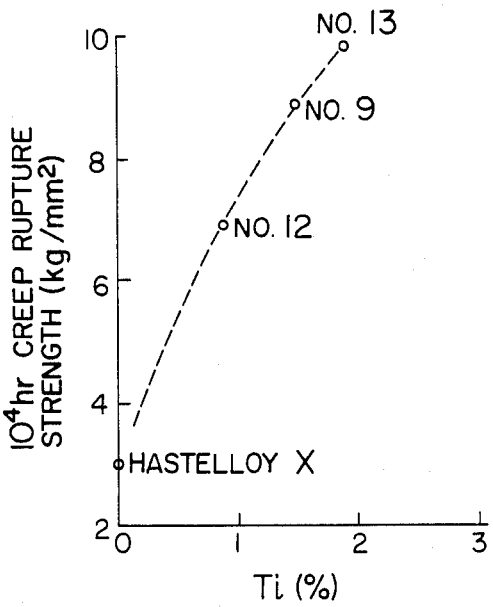
FIG. 12 to 14 are diagrams showing how $10^4$-hour creep rupture strength, $10^3$-hour creep rupture reduction of area and the proof stress are related to Ti content of the alloy.
Figure 13:
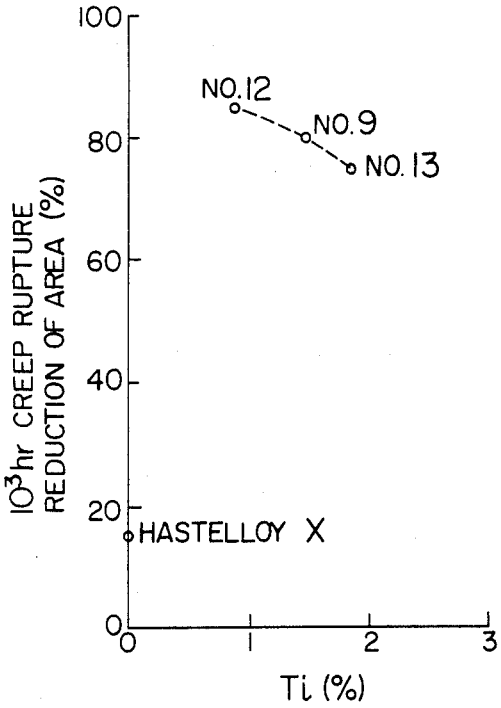
Figure 14:
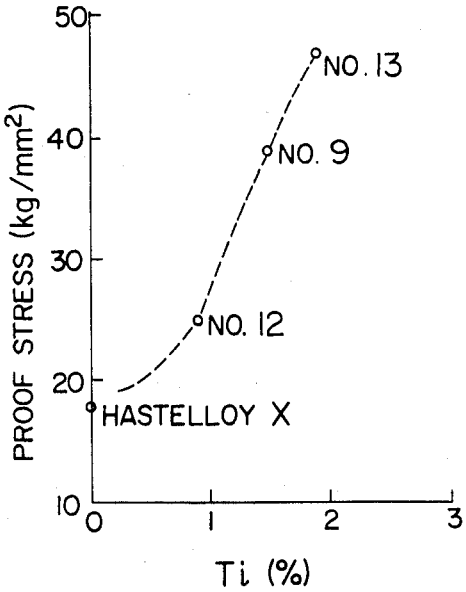

FIGS. 12 to 14 are diagrams showing the influence of Ti on the $10^4$-hour creep rupture strength, $10^3$-hour creep rupture reduction of area and proof stress which are shown in Table 2. As will be understood from these Figures, addition of Ti to alloys having large W and Co contents remarkably increases the $10^4$-hour creep rupture strength and $10^3$-hour creep rupture reduction of area. Particularly, Ti content not smaller than 1.0 wt % produced remarkable effects such as increase in $10^3$-hour rupture reduction of area of up to 60% or higher, proof stress up to 25 Kg/mm$^2$ or higher and $10^4$-hour creep rupture strength up to 6 Kg/mm$^2$ or higher.

The alloys employed in the test for obtaining data shown in these Figures were prepared by adding various amounts of Ti to an Ni base alloy having a composition consisting essentially of 0.07 to 0.08 wt % of C, 0.31 to 0.32 wt % of Si, 0.68 wt % of Mn, 22.0 to 22.1 wt % of Cr, 14.9 to 15.5 wt % of W, 29.8 to 30.1 wt % of Co, 0.8 wt % of Al, 0.003 to 0.005 wt % of B, 0.01 to 0.07 wt % of La and, in addition, not greater than 0.1 wt % of Fe.

Embodiment 2

Sheets of 3.2 mm thick were produced by hot rolling from the alloys of samples Nos. 5 and 9 of the invention and the hastelloy X as the comparative material. The sheets of test alloys of samples Nos. 5 to 9 were subjected to a solid solution treatment conducted at 1175° C. for 40 minutes, while the sheet of hastelloy X was subjeted to a solid solution treatment conducted at 1150° C. for 30 minutes. With disc-shaped test pieces cut out from these sheets, a heat cycle test was conducted to examine the resistance to thermal fatigue in these alloys. More specifically the disc-shaped test pieces had a diameter of 70 mm and a thickness of 3.2 mm and was provided with a U-shaped radial notch cut from the periphery radially inwardly to a radial depth of 4 mm and width of 2 mm with the radially inner end rounded at a radius r of 1 mm.

Figure 15:
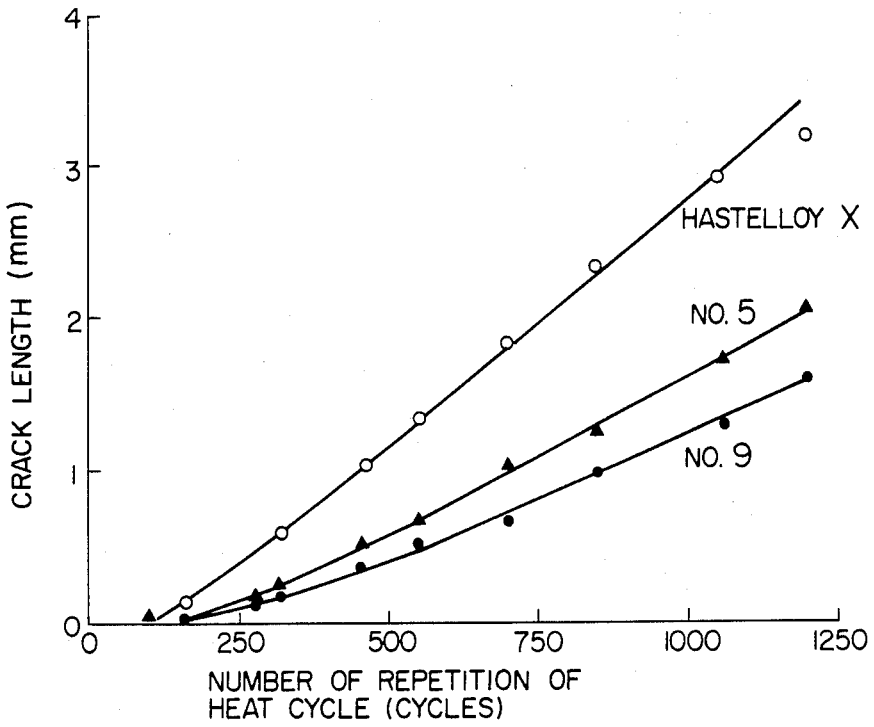
FIG. 15 is a diagram showing the relationship between the crack length and the number of repetition of heat cycles.

FIG. 15 shows crack lengths as measured with these test pieces after application of 1200 consecutive heat cycles each of which consists of holding at 300° C. for 30 minutes and then holding at 850° C. for 30 minutes. Cracks were caused from the bottom of U-shaped notch. The crack lengths appearing in the test pieces prepard from the alloys of sample Nos. 5 and 9 were smaller than those in test pieces prepared from hastelloy X. From this fact, it is understood that the alloys used as the material of gas turbine combustor in accordance with the invention, which exhibit superior creep rupture strength, creep rupture reduction of area and proof stress at high temperature, are superior also in the resistance to thermal fatigue which is caused when the alloys are subjected to repetitional heat cycles.

Embodiment 3

A gas turbine combustor shown in FIG. 1 was fabricated from the alloy of sample No. 14 shown in Table 1. The alloy was formed by hot rolling and cold rolling into sheets of 1 to 3 mm thick, followed by a solid solution treatment conducted at 1175° C. The liner 5, transition piece 4 and the cap 6 were formed into desired shape from these sheets, and were assembled and united together by welding to form the combustor. The welding was conducted by but tungsten inert gas (TIG) welding, using a welding wire having the same composition as the base metal, i.e. the alloy of sample No. 14. The louver ports 1 and the cross-fire tube 2 were formed in advance to the welding. After the welding, the combustor was heated to and held at 1175° C. for 15 minutes followed by an air cooling for removing the residual strains.

It was confirmed that no cracking was caused during the cold working nor during welding, in the above-described process of fabrication of the gas turbine combustor.

The gas turbine combustor of the invention thus produced offers advantages such as longer service life due to the use of alloy having high resistance to thermal stress and possibility of use of combustion gas of higher temperature, when employed in actual power unit which operates with light or heavy oil fuel.

What is claimed is:

1. A gas turbine combustor defining a combustion chamber for comution of injected fuel and for introduction of the resultant hot combustion gas to nozzles of gas turbine, said combustor being cylindrical and being formed by shaping hot-worked alloy material into a desired shape by cold-working and welding of the material, wherein the parts of said combustor subjected to said hot combustion gas are made from an alloy material subjected to plastic working and having a composition consisting essentially of 0.02 to 0.2 wt % of C, not greater than 1 wt % of Si, not greater than 1.5 wt % of Mn, 18 to 26 wt % of Cr, 12 to 20 wt % of W, 20.5 to 31 wt % of Co, 0.1 to 1.2 wt % of Al, 0.5 to 1.9 wt % of Ti, 0.002 to 0.01 wt % of B, not greater than 0.5 wt % of a rare earth element selected from the group consisting of La and mischmetal, not greater than 5 wt % of Fe, not greater than 0.1 wt % of Mg, not greater than 0.5 wt % of Zr, not greater than 3 wt % of Nb and the balance not smaller than 20 wt % of Ni, and a fully austenite structure.

2. A gas turbine combustor according to claim 1 wherein said combustor includes a cap connected to a fuel injection nozzle, a liner connected to said cap and a transition piece connected to said liner, and at least one of them is made from said alloy.

3. A gas turbin combustor defining a combustion chamber for combustion of injected fuel and for introduction of the resultant hot combustion gas to nozzles of a gas turbine, said combustor being cylindrical and being formed by shaping hot-worked alloy material into a desired shape by cold-working and welding of the material, wherein the parts of said combustor subjected to said hot combustion gas is made from an alloy material subjected to plastic working and having a composition consisting essentially of 0.05 to 0.15 wt % of C, 0.2 to 0.6 wt % of Si, 0.4 to 1.0 wt % of Mn, 20 to 24 wt % of Cr, 14 to 16 wt % of W, 29 to 31 wt % of Co, 0.6 to 0.9 wt % of Al, 1 to 2 wt % of Ti, 0.002 to 0.01 wt % of B, 0.005 to 0.1 wt % of a rare earth element selected from the group consisting of La and mischmetal, not greater than 5 wt % of Fe, not greater than 0.1 wt % of Mg, not greater than 0.5 wt % of Zr, not greater than 3 wt % of Nb and the balance not smaller than 20 wt % of Ni, and a fully austenite structure.

4. A gas turbine combustor defining a combustion chamber for combustion of injected fuel and for introduction of the resultant hot combustion gas to nozzles of a gas turbine, said combustor being cylindrical and being formed by shaping hot-worked alloy material into a desired shape by cold-working and welding of the material, wherein the parts of said combustor subjected to said hot combustion gas is made from an alloy material subjected to plastic working and having a composition consiting essentially of 0.02 to 0.2 wt % of C, not greater than 1 wt % of Si, not greater than 1.5 wt % of Mn, 18 to 26 wt % of Cr, 12 to 20 wt % of W, 20.5 to 31 wt % of Co, 0.1 to 1.2 wt % of Al, 0.5 to 1.9 wt % of Ti, 0.002 to 0.01 wt % of B, 0.03 to 0.10 wt % of La, not greater than 5 wt % of Fe, not greater than 0.1 wt % of Mg, not greater than 0.5 wt % of Zr, not greater than 3 wt % of Nb and the balance not smaller than 20 wt % of Ni, and a fully austenite structure.

5. A gas turbine combustor defining a combustion chamber for combustion of injected fuel and for introduction of the resultant hot combustion gas to nozzles of a gas turbine, said combustor being cylindrical and being formed by shaping hot-worked material into a desired shape by cold-working and welding of the material, wherein the parts of said combustor subjected to said hot combustion gas is made from an alloy material subjected to plastic working and having a composition consisting essentially of 0.05 to 0.15 wt % of C, 0.2 to 0.6 wt % of Si, 0.4 to 1.0 wt % of Mn, 20 to 24 wt % of Cr, 14 to 16 wt % of W, 29 to 31 wt % of Co, 0.6 to 0.9 wt % of Al, 1 to 2 wt % of Ti, 0.002 to 0.01 wt % of B, 0.03 to 0.10 wt % of La, not greater than 5 wt % of Fe, not greater than 0.1 wt % of Mg, not greater than 0.5 wt % of Zr, not greater than 3 wt % of Nb and the balance not smaller than 20 wt % of Ni, and a fully austenite structure.

* * * * *